US011780652B1

(12) United States Patent
Ronayne

(10) Patent No.: US 11,780,652 B1
(45) Date of Patent: Oct. 10, 2023

(54) TAPERED CLOSURE AND CLOSURE SYSTEM

(71) Applicant: Pretium Packaging, L.L.C., Chesterfield, MO (US)

(72) Inventor: John Ronayne, Ballyconnell (IE)

(73) Assignee: Pretium Packaging, L.L.C., Chesterfield, MO (US)

( * ) Notice: Subject to any disclaimer, the term of this patent is extended or adjusted under 35 U.S.C. 154(b) by 0 days.

(21) Appl. No.: 17/657,032

(22) Filed: Mar. 29, 2022

(51) Int. Cl.
*B65D 41/34* (2006.01)
*B65D 41/32* (2006.01)

(52) U.S. Cl.
CPC ..... *B65D 41/3447* (2013.01); *B65D 41/325* (2013.01); *B65D 2251/10* (2013.01); *B65D 2251/20* (2013.01); *B65D 2401/30* (2020.05)

(58) Field of Classification Search
CPC ..... B65D 41/3428; B65D 41/3409; B65D 41/3447; B65D 41/3442; B65D 41/325; B65D 41/04; B65D 41/0485; B65D 1/0238; B65D 2401/30; B65D 2401/15; B65D 2251/10; B65D 2251/065; B65D 2251/20
USPC ..... 215/252, 253, 250, 254, 329, 332, 341, 215/316, 44, 43; 220/266, 265, 294, 293, 220/288
See application file for complete search history.

(56) References Cited

U.S. PATENT DOCUMENTS 4,394,918 A 7/1983 Grussen
4,798,303 A * 1/1989 Arnold ..... B65D 41/04 215/329
5,553,727 A * 9/1996 Molinaro ..... B65D 41/0421 215/354
5,785,195 A * 7/1998 Zwemer ..... B65D 41/04 215/349
6,213,321 B1 * 4/2001 Zumbuhl ..... B65D 41/3428 215/253
7,694,835 B1 4/2010 Montgomery
10,654,625 B2 5/2020 Migas et al.
10,836,544 B2 11/2020 Kim
2009/0283492 A1 11/2009 Molinaro et al.
2011/0114593 A1 * 5/2011 Ishii ..... B65D 55/16 215/253

(Continued)

FOREIGN PATENT DOCUMENTS

BR 9407354 A * 10/1996 ..... B65D 41/0428
EP 0004500 A2 * 3/1979 ..... B65D 41/34

(Continued)

OTHER PUBLICATIONS

Naitove, Matthew, "Packaging: New System Produces Wide Variety of 'Tethered' Bottle Caps", Plastics Technology, Jul. 9, 2020.

(Continued)

*Primary Examiner* — Robert J Hicks
(74) *Attorney, Agent, or Firm* — Armstrong Teasdale LLP

(57) ABSTRACT

A closure for a container includes a top panel, a skirt depending from the top panel and extending circumferentially about a central axis, a tamper-evident band attached to the skirt, and at least one thread extending from an interior surface of the skirt. The skirt extends from a first end attached to the top panel to a second end opposite the first end. The skirt is tapered radially outward from the first end to the second end such that a diameter of the skirt at the second end is greater than the diameter of the skirt at the first end.

20 Claims, 5 Drawing Sheets

(56) References Cited

U.S. PATENT DOCUMENTS

| | | | | |
|---|---|---|---|---|
| 2012/0031871 | A1* | 2/2012 | Molinaro | B65D 1/0246 215/44 |
| 2021/0094733 | A1 | 4/2021 | Bloom et al. | |
| 2022/0097923 | A1* | 3/2022 | Khattar | B65D 55/16 |

FOREIGN PATENT DOCUMENTS

| | | | | | |
|---|---|---|---|---|---|
| JP | 11147551 | A | * | 6/1999 | B65D 41/3428 |
| JP | 2001114313 | A | * | 4/2001 | B65D 41/3428 |
| JP | 2001146244 | A | * | 5/2001 | B65D 41/3428 |
| WO | 2020227813 | A1 | | 11/2020 | |
| WO | 2021019419 | A1 | | 2/2021 | |

OTHER PUBLICATIONS

Extended European Search Report issued in European Patent Application No. 22179717.8, dated Nov. 17, 2022, 7 pages.

* cited by examiner

TAPERED CLOSURE AND CLOSURE SYSTEM

BACKGROUND

The field of the disclosure relates generally to a closure and a closure system, and more specifically to a closure that includes a tapered sidewall or skirt and a tapered internal thread, and a container that includes a tapered neck and a tapered external thread.

Containers are often used to store products or contents. It is often desirable to close the container with a closure (e.g., a bottle cap) in order to contain the product or contents in the container. Some known closures include a tamper-evident band that indicates whether the closure has been tampered with or removed from the container. Tamper-evident bands are desirable in certain applications (for example, in the food and beverage industry, pharmaceutical industry, etc.) in order to promote the safety of consumer products.

Some known closures also include a tether that keeps the closure tethered or attached to the container when the closure is removed from the container. Tethered closure assemblies help to reduce the chance that the closure may be lost when it is removed from the container.

During certain procedures, such as container capping and/or filling operations, the closure is placed on top of the container to cover an opening in the container, and is subsequently secured to the neck of the container. In some of these procedures, the closure is not immediately secured (e.g., threaded) to the container, and simply rests on top of the container. During these procedures, the container may be jostled (e.g., due to movement of the container along production or filling lines). If the closure is not firmly seated on the container neck, the closure may be disturbed and/or fall off the container, which can result in misapplied closures, closures being improperly presented to a capper of a capping/filling line, containers not being closed, etc.

Accordingly, there is a need for improved closures and corresponding closure systems.

BRIEF DESCRIPTION

In one aspect, a closure for a container includes a top panel, a skirt depending from the top panel and extending circumferentially about a central axis, a tamper-evident band attached to the skirt, and at least one thread extending from an interior surface of the skirt. The skirt extends from a first end attached to the top panel to a second end opposite the first end. The skirt is tapered radially outward from the first end to the second end such that a diameter of the skirt at the second end is greater than the diameter of the skirt at the first end.

In another aspect, a closure for a container includes a top panel including a transition section along an outer peripheral edge thereof, a skirt depending from the top panel at the transition section and extending circumferentially about a central axis, a tamper-evident band, a deflectable tab, and a plurality of threads extending from an interior surface of the skirt. The skirt extends from a first end attached to the top panel to a second end opposite the first end. The tamper-evident band is frangibly attached to the skirt by a plurality of frangible tabs at the second end of the skirt. The tamper-evident band is tethered to the skirt by a hinge such that the skirt remains connected to the tamper-evident band after the frangible tabs are separated. The deflectable tab extends from the hinge and is operable to engage a retention section of the tamper-evident band to hold the closure in an opened position. The skirt is tapered radially outward from the first end to the second end such that a diameter of the skirt at the second end is greater than the diameter of the skirt at the first end, and such that a radial spacing between the plurality of threads and the central axis increases as each of the threads extends towards the second end of the skirt.

In yet another aspect, a closure system includes a container and a closure threadably connectable to the container. The container includes a sidewall defining a cavity and a neck extending from the sidewall and defining an opening to the cavity. The neck extends from a first end defining the opening to a second end joined to the sidewall, and includes at least one thread on an exterior surface thereof. The neck is tapered radially outward from the first end towards the second end. The closure includes a top panel, a skirt depending from the top panel extending circumferentially about a central skirt axis, a tamper-evident band attached to the skirt, and at least one thread extending from an interior surface of the skirt and configured to threadably engage the at least one thread of the container neck. The skirt extends from a first end attached to the top panel to a second end opposite the first end. The skirt is tapered radially outward from the first end to the second end such that a diameter of the skirt at the second end is greater than the diameter of the skirt at the first end. A taper angle of the skirt corresponds to a taper angle of the neck.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

FIG. 6.

DETAILED DESCRIPTION

A closure and a corresponding closure system are described herein that facilitate improved resistance of a closure that is placed over an opening of a container to being inadvertently removed from the container, for example, during container filling and/or capping operations, and during use by consumers. For example, embodiments of the closures and closure systems disclosed herein utilize a taper effect to facilitate placement and/or securement of the closure on the neck of a container, e.g., during the manufacturing and assembly process.

In contrast to at least some known closures and closure systems, the closures and closure systems of the present disclosure can have a thread height that is substantially constant (i.e., is not reduced) along the height or length of the closure and/or the container neck. For example, some known closures and closure systems have a reduced thread height near the bottom of the closure and/or near the top of the neck of the container, with the height of the thread increasing towards the top of the closure and/or the bottom of the neck. While this can facilitate positioning the closure on the container neck (e.g., during a filling operation of the container), the reduced thread height can cause the closure to be improperly or insufficiently secured to the container neck, resulting in the closure being inadvertently removed (e.g., at later stages of a filling operation or during transport). Embodiments of the closures and closure systems described herein can include container necks having external threads with a substantially constant or non-reduced height near the opening of the container and/or closures having internal threads with a substantially constant or non-reduced height.

Figure 1:
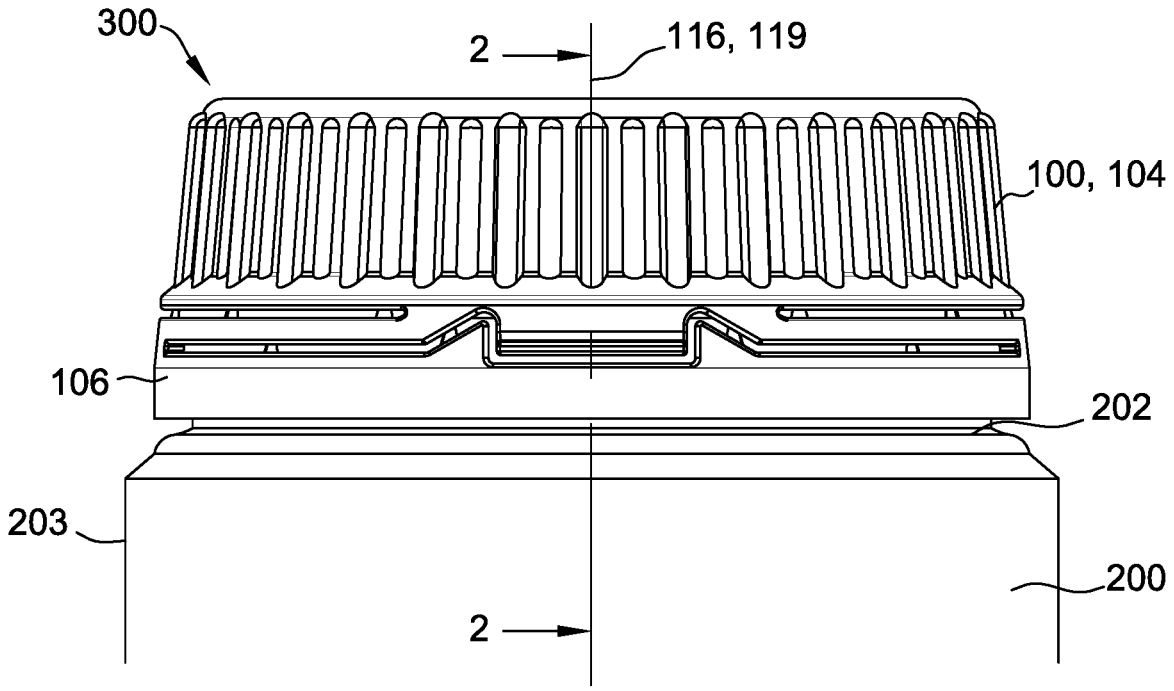
FIG. 1 is a side view of an example closure system including a closure and a portion of a container.
Figure 2:
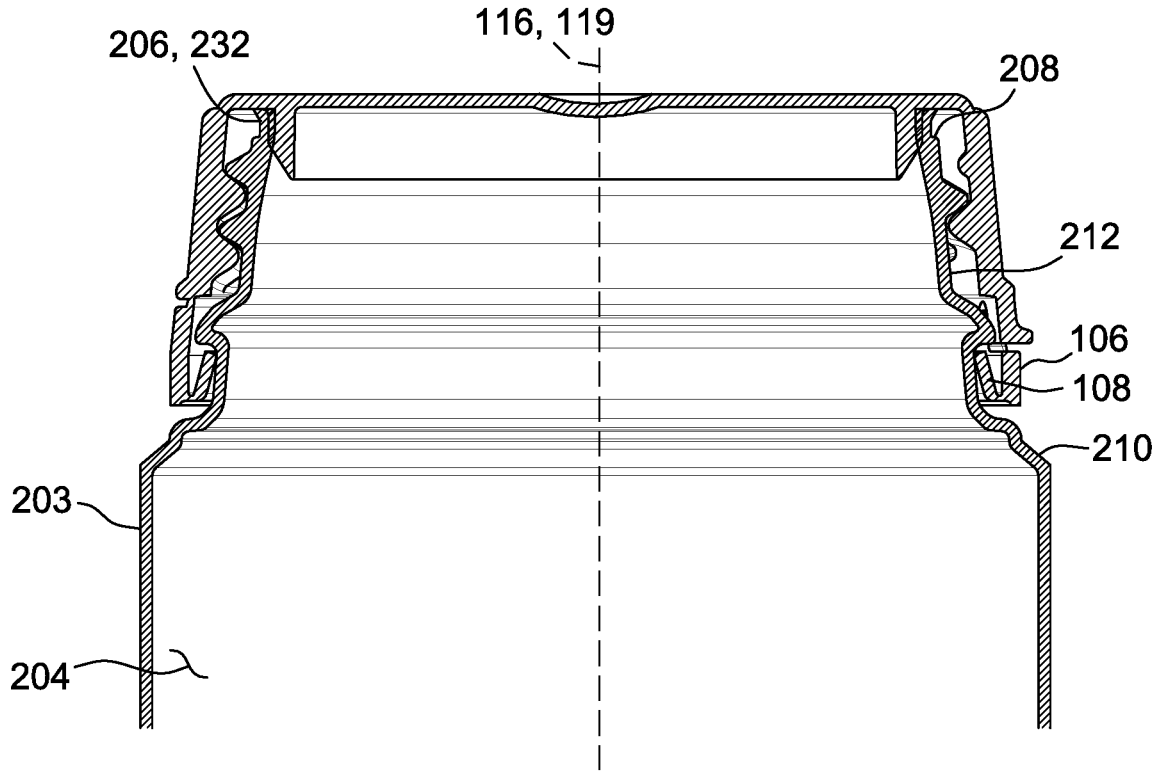
FIG. 2 is a sectional view of the closure system of FIG. 1 taken along line 2-2 in FIG. 1.

FIG. 1 is a side view of an example closure system 300 that includes a closure 100 and a container 200. FIG. 2 is a sectional view of the closure system 300 taken along line 2-2 in FIG. 1. The closure 100 is connected to the container 200 at a neck 202 of the container 200.

Figure 3:
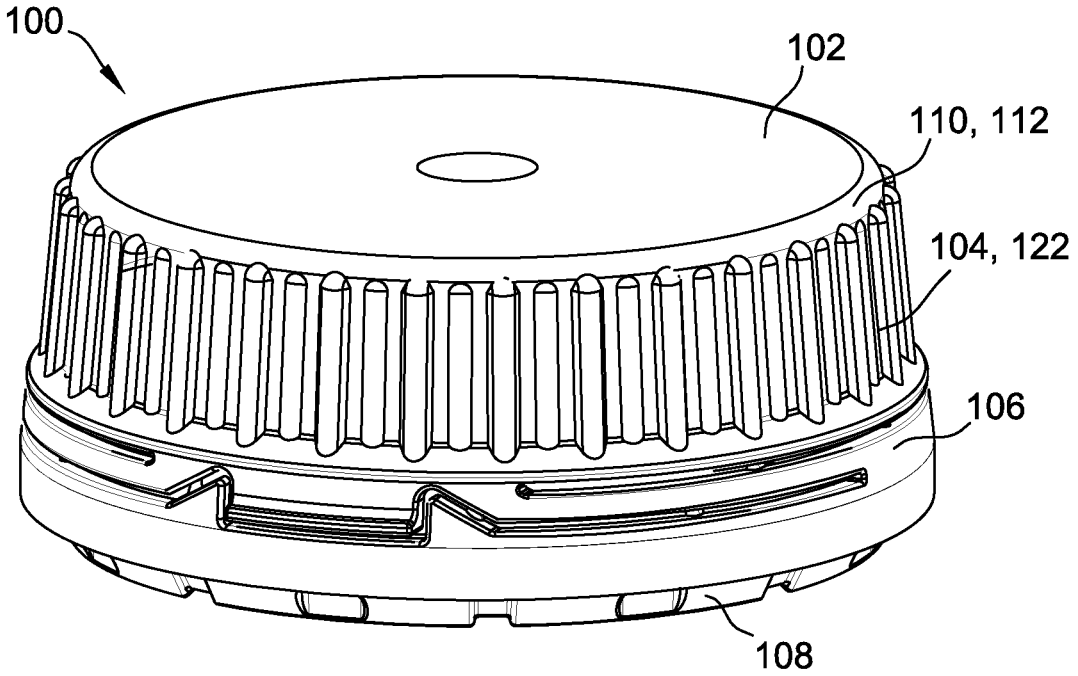
FIG. 3 is a top perspective view of the closure of FIG. 1.
Figure 4:
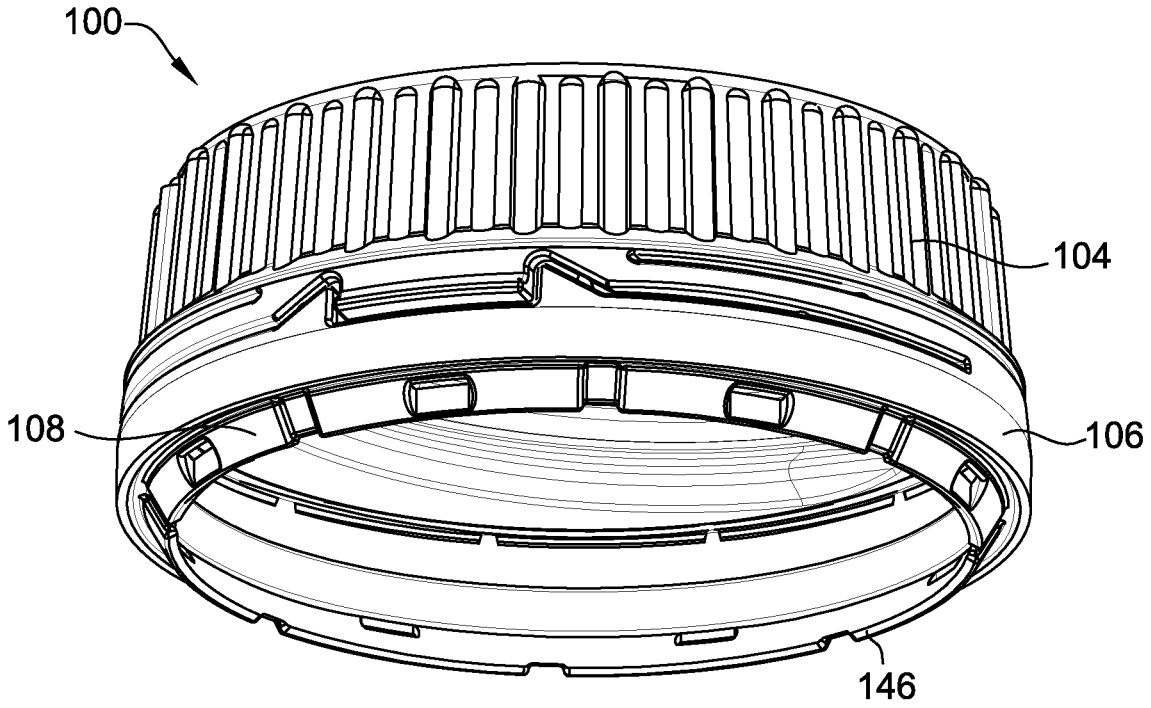
FIG. 4 is a bottom perspective view of the closure of FIG. 3.
Figure 5:
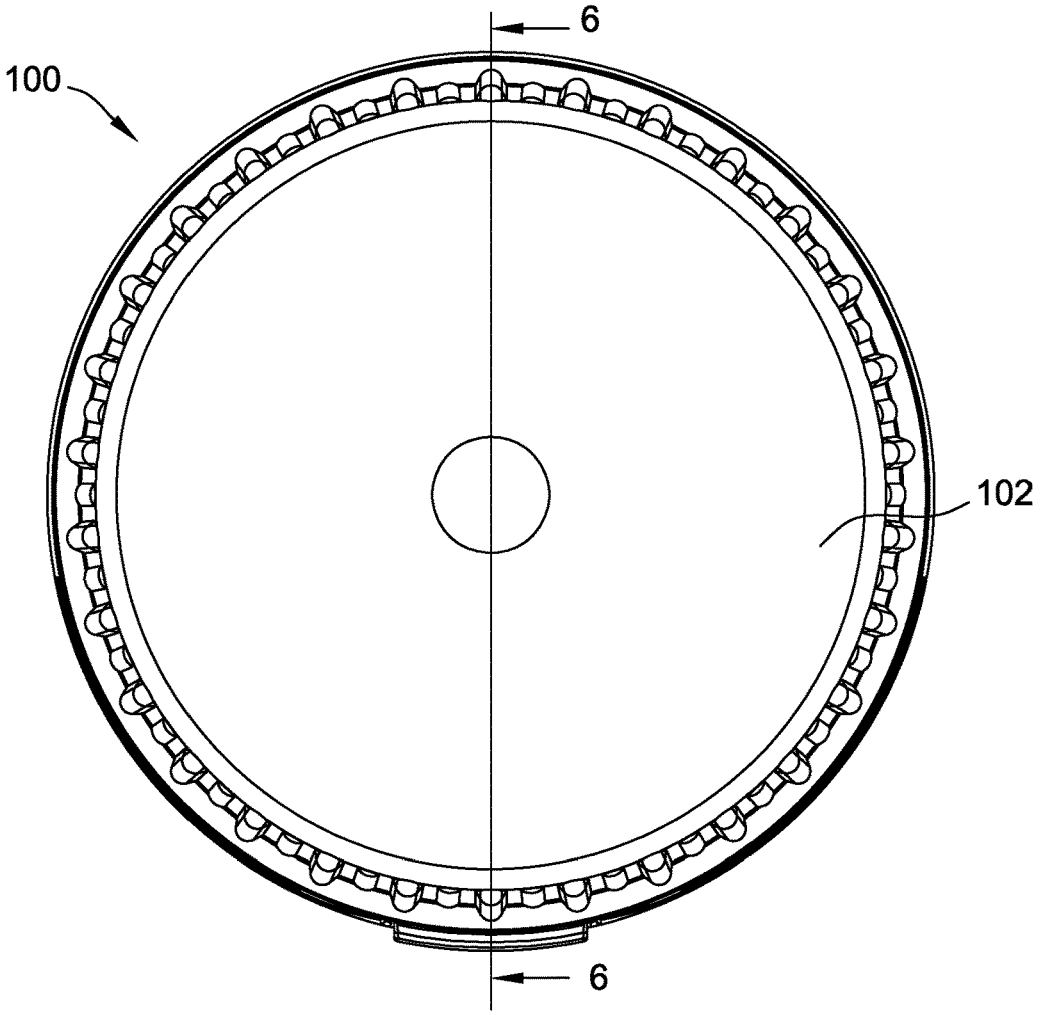
FIG. 5 is a top view of the closure of FIG. 3.

FIG. 3 is a top perspective view of the closure 100, FIG. 4 is a bottom perspective view of the closure 100, and FIG. 5 is a top view of the closure 100. In the example embodiment, the closure 100 includes a top panel 102, a sidewall or skirt 104 depending from the top panel 102, a tamper-evident band 106, and an attachment band 108.

The closure 100 of the illustrated embodiment has a generally closed cylindrical shape, with the top panel 102 being generally circular and the skirt 104 being generally cylindrical. Additionally, the top panel 102 includes a transition section 110 along an outer peripheral edge 112 thereof that joins the skirt 104. In the illustrated embodiment, the transition section 110 is generally curved. In other embodiments, the transition section 110 can be of any suitable configuration that allows the closure 100 and/or the closure system 300 to function as described herein.

Figure 6:
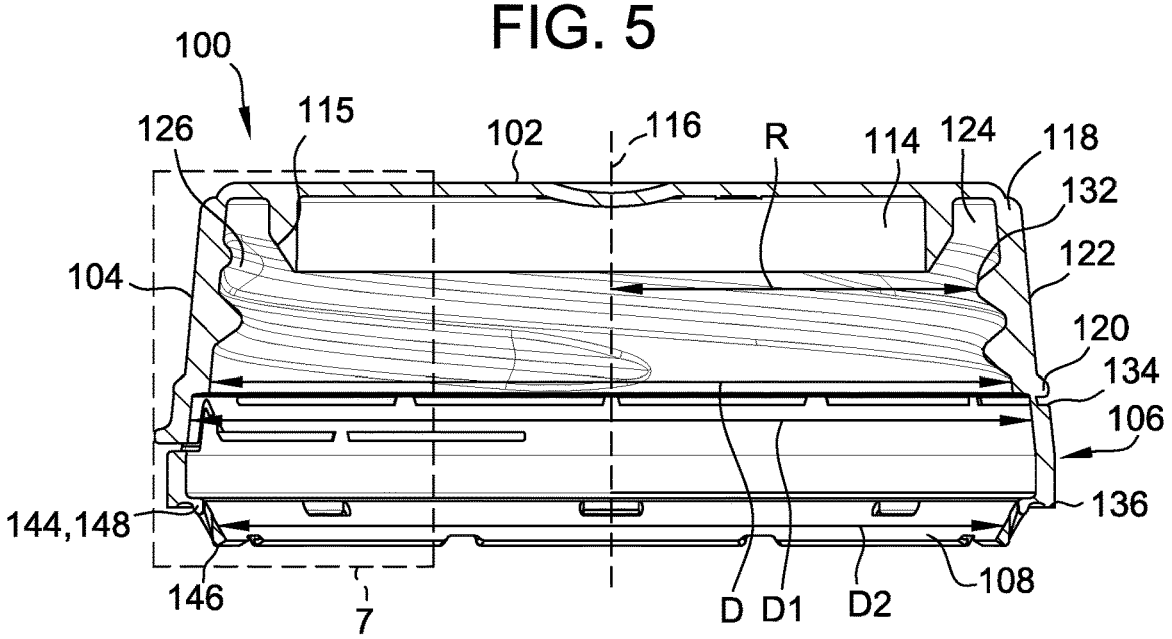
FIG. 6 is a sectional view of the closure of FIG. 3 taken along line 6-6 in FIG. 5.

FIG. 6 is a sectional view taken along line 6-6 in FIG. 5. As shown in FIG. 6, the example embodiment includes a sealing ring 114 that depends from the top panel 102 and extends circumferentially about a central axis 116 of the closure 100. In other embodiments, the sealing ring 114 may be omitted, and the closure 100 may form a seal with the container 200 by other means, such as an induction heat seal. The central axis 116 coincides with line 2-2 in FIG. 1, and also coincides with the central axis 119 of the container 200 when the closure 100 is installed on and secured to the container 200, as described further herein. The sealing ring 114 is spaced radially inward from the skirt 104, and is configured to sealingly engage a portion of the container 200 to which closure 100 is connected, for example, to inhibit contents from the container 200 from leaking or spilling out. The sealing ring 114 is spaced radially inward from the skirt 104 by a distance sufficient to receive a portion of the container 200 (e.g., neck 202) therebetween. In FIG. 6, the sealing ring 114 is shown as having a cross-sectional profile that includes a bottom edge 115 that is slanted towards the central axis 116. The slanted bottom edge 115 of the profile of the sealing ring 114 enables the sealing ring 114 to more effectively contact and seal an opening of the container (e.g., opening 232 shown in FIG. 9) to which closure 100 is connected. However, the sealing ring 114 may have any suitable configuration that allows the closure 100 and/or the closure system 300 to function as described herein.

The skirt 104 depends from the top panel 102 and extends circumferentially about the central axis 116. The skirt 104 is spaced radially outward from the sealing ring 114. In the illustrated embodiment, the skirt 104 extends from a first end 118 attached to the transition section 110 of the top panel 102 to a second end 120 opposite to the first end 118. The second end 120 may be, for example, at a location where the skirt 104 attaches to the tamper-evident band 106. In the illustrated embodiment, the skirt 104 includes an exterior surface 122 and an interior surface 124 with at least one internal thread 126 extending radially inward from the interior surface 124. The at least one internal thread 126 can be a single, continuous internal thread extending helically around the interior surface 124 of the skirt 104, or the at least one thread 126 can include multiple different threads. As shown in FIG. 6, for example, the at least one internal thread 126 includes three separate threads 126. Each of the separate threads 126 extends helically around the interior surface 124 of the skirt 104 from the second end 120 towards the first end 118. Moreover, in this embodiment, each thread 126 has a substantially constant height as the thread extends from the second end 120 towards the first end 118. For example, each thread 126 may have a constant height except for the thread start and end portions.

Figure 7:
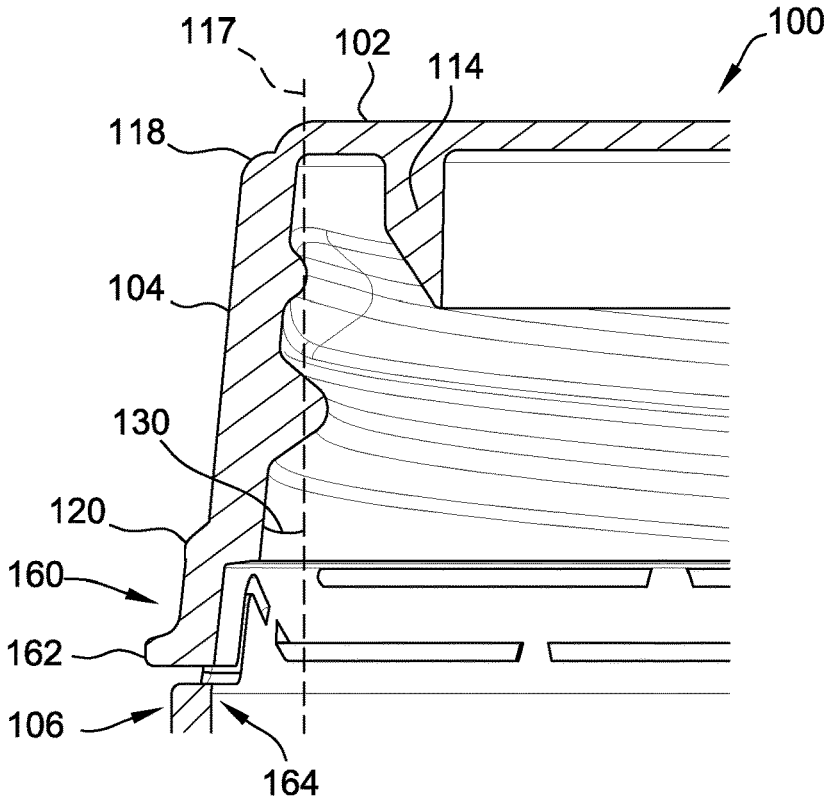
FIG. 7 is an enlarged view of a portion of the closure shown in FIG. 8 is a side view of the closure of FIG. 3.

FIG. 7 is an enlarged view of a portion of the closure 100 shown in FIG. 6. As shown in FIG. 7, the skirt 104 of the example closure 100 tapers radially outwards from the first end 118 to the second end 120 such that a diameter D of the skirt 104 (shown in FIG. 6) is greater at the second end 120 than at the first end 118. The skirt 104 can taper radially outward from the first end 118 to the second end 120 at any suitable angle that enables the closure 100 and/or the closure system 300 to function as described herein. In some embodiments, an angle 130 of the taper, shown with reference between the interior surface 124 of the skirt 104 and an axis 117 parallel to the central axis 116 in FIG. 7, can be between about 1° and about 10°, between about 1° and about 8°, between about 2° and about 10°, between about 1° and about 6°, between about 3° and about 8°, between about 5° and about 10°, between about 1° and about 4°, between about 3° and about 6°, between about 5° and about 8°, between about 7° and about 10°, between about 3° and about 5°, between about 4° and about 6°, or between about 5° and about 7°.

According to this configuration, the skirt 104 includes a radial taper of the diameter D (specifically, the diameter of the interior surface 124) of the skirt 104. The radial taper of the skirt 104 can be, for example and without limitation, a generally linear taper of the diameter D of the skirt 104, as is shown in the embodiment depicted in FIG. 6. However, the radial taper of the diameter D of the skirt 104 can be of any suitable configuration (e.g., non-linear, non-constant, etc.) that enables closure 100 and/or closure system 300 to function as described herein. In some embodiments, the diameter D of the skirt 104 at the second end 120 is between 1-10% greater than the diameter D of the skirt 104 at the first end 118, between 1-8% greater, between 2-8% greater, between 1-5% greater, between 2-6% greater, between 1-4% greater, between 2-5% greater, or between 2-4% greater. In one particular embodiment, the diameter D of the skirt 104 at the second end 120 is between 1-2 millimeters greater at the second end 120 of the skirt 104 than the diameter D at the first end 118 of the skirt 104.

Further, as shown in FIG. 6, a radial spacing R between the central axis 116 and a peak or interior edge 132 of the internal threads 126 increases as the internal threads 126 extend toward the second end 120 of the skirt 104 due to the tapered skirt 104. That is, at locations of the internal threads 126 that are nearer to the first end 118 of the skirt 104, the radial spacing between the internal thread 126 and the central axis 116 may be smaller than the radial spacing between the internal thread 126 and the central axis 116 at locations that are nearer to the second end 120 of the skirt 104. In the illustrated embodiment, the radial spacing R between the interior edge 132 of the threads 126 and the central axis 116 increases while the height of each thread remains the same or substantially the same. That is, the height of each thread 126 does not decrease (with the exception of the start portion of each thread 126 at the second end 120 as shown in FIG. 6) while the radial spacing R increases as the threads 126 extend towards the second end 120. The increase in the radial spacing R between the internal threads 126 and the central axis 116 may increase, for example, linearly, or any other suitable way that enables the closure 100 and/or closure system 300 to function as described herein.

Figure 8:
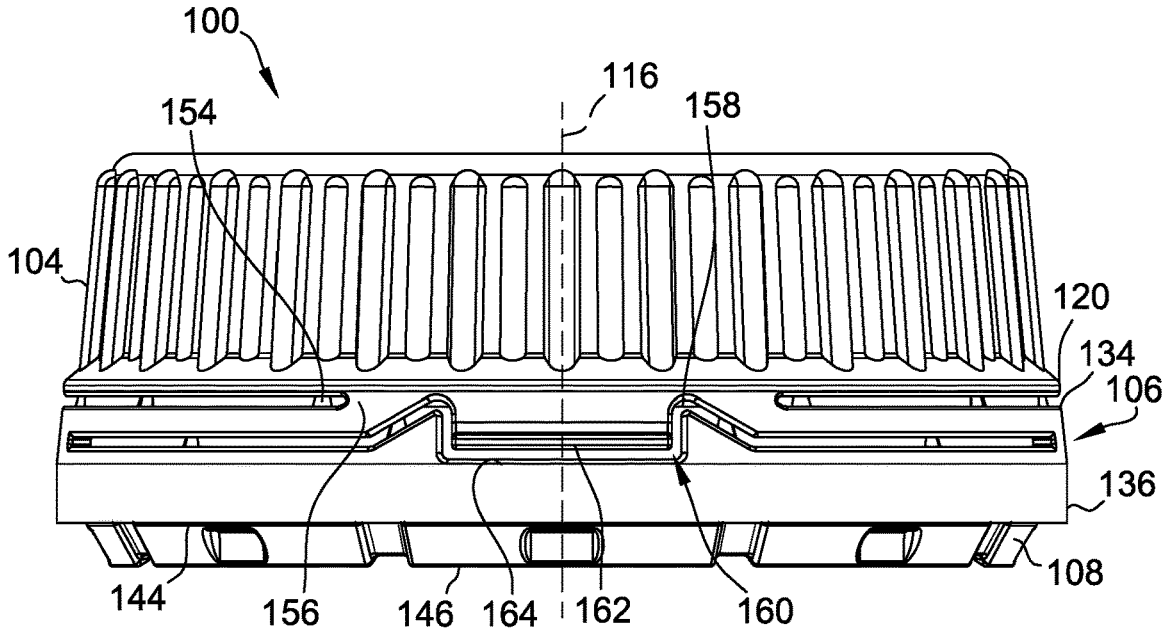

With additional reference to FIG. 8, the tamper-evident band 106 is attached to the skirt 104 at the second end 120 of the skirt 104, and extends circumferentially about the central axis 116. The tamper-evident band 106 extends from a first end 134 attached to the skirt 104 (e.g., by one or more frangible tabs 154, described below) to an opposing second end 136. The attachment band 108 is hingedly connected to the second end 136 of the tamper-evident band 106, and extends radially inward therefrom. More specifically, the attachment band 108 extends from a first end 144, attached to the second end 136 of the tamper-evident band 106 by a hinged attachment 148 (shown in FIG. 6), to a second, free end 146. The attachment band 108 is illustrated in an unfolded configuration in FIGS. 3, 4, 6, and 8, although the attachment band 108 can be positioned in a folded configuration (shown in FIGS. 2, 9, and 10), for example, prior to the closure 100 being attached to the container 200. For example, the attachment band 108 can be folded radially inward about the hinged attachment 148 from the unfolded configuration to the folded configuration prior to attaching the closure 100 to the container 200. In the folded configuration, the attachment band 108 inhibits or prevents the tamper-evident band 106 from being removed from the container 200 when the closure 100 is removed (e.g., unthreaded) from the container 200.

As shown in FIG. 6, the tapered closure 100 can result in the tamper-evident band 106 having a diameter D1 that is larger than the diameter D of the skirt 104, for example, at any location along the skirt 104. For example, the radial taper of the skirt 104 can continue into the diameter D1 of the tamper-evident band 106. In the illustrated embodiment, for example, the diameter D1 at the second end 136 of the tamper-evident band 106 is larger than the diameter D1 of the tamper-evident band 106 at the first end 134. The tamper-evident band 106 can be continuously tapered from the first end 134 to the second end 136, or the tamper-evident band 106 can be partially tapered (e.g., tapered along a portion or portions of the tamper-evident band 106). That is, the diameter D1 of the tamper-evident band 106 can be tapered in any suitable manner or remain constant at any portion of the tamper evident-band 106 that enables the closure 100 and the closure system 300 to function as described herein. In other embodiments, the tamper-evident band 106 is not tapered and has a substantially constant diameter D1 from the first end 134 to the second end 136.

The tapered configuration of the closure (e.g., the increased diameter D of the skirt 104 and increased radial spacing of the internal threads 126 at the second end 120 of the skirt 104) can result in a relatively larger diameter D2 of the attachment band 108 in the folded configuration (shown in FIG. 9) as compared to prior closure designs. A tamper-evident band 106 that is also tapered can further increase the diameter D2 of the attachment band 108 in the folded configuration. As described further herein, the increased diameter D2 of the attachment band 108 in the folded configuration can facilitate retaining the closure 100 on the container 200 when the closure 100 is placed on the container 200, but prior to when the closure 100 is further secured (e.g., threaded) to the container 200 (e.g., during a filling operation of container 200).

In some embodiments, the tamper-evident band 106 is frangibly attached to the skirt 104 by at least one frangible tab 154 (shown in FIG. 8). When the closure 100 is removed, either partially or entirely, from the container 200 for the first time, the at least one frangible tab 154 is broken such that tamper-evident band 106 is no longer connected to the skirt 104 by the at least one frangible tab 154. Breaking, either partially or entirely, of the at least one frangible tab 154 may provide an indication the that closure 100 has previously been opened or removed from container 200. In the illustrated embodiment, the tamper-evident band 106 is connected to the skirt 104 by 9 frangible tabs 154, although other embodiments may include more or less than 9 frangible tabs.

The tamper-evident band 106 may also include a hinge 156 formed in the tamper-evident band 106 (shown in FIG. 8). In some embodiments, the tamper-evident band 106 is tethered to the skirt 104 by the hinge 156 such that the skirt 104 and the tamper-evident band 106 remain tethered or attached via the hinge 156, even after the frangible tabs 154 are broken. When the closure 100 is installed and secured on a container, the hinge 156 can facilitate movement of the closure 100 between an open position and a closed position, while also keeping the closure 100 connected to the container 200.

The tamper-evident band 106 can also include one or more circumferentially-extending slots 158 that facilitate hingedly moving the closure 100 about the hinge 156. The example embodiment includes a single continuous slot 158 that is generally defined by parallel edges of the tamper-evident band 106. In the embodiment shown in FIG. 8, the slot 158 is generally circumferentially symmetrical about a center point of the hinge 156. The slot 158 extends circumferentially about the tamper-evident band 106 a sufficient distance to enable hingedly moving the closure between a closed position (shown in FIGS. 1 and 2) and an opened position (not shown) about the hinge 156.

In the illustrated embodiment, the hinge 156 also includes a deflectable tab 160 including a tooth 162 that extends radially outward from the tab 160. The deflectable tab 160 (specifically, the tooth 162) may be operable to engage a retention section 164 of the tamper-evident band 106 (shown in FIG. 7) to retain the closure 100 in the opened position. For example, the bottom of the deflectable tab 160 may be spaced from the retention section 164 of the tamper-evident band 106 by an opening or gap that is sized to permit the tooth 162 of the deflectable tab 160 to pass therethrough when the closure 100 is rotated from a closed position (shown in FIG. 7) to an opened position. When the closure 100 is in the opened position, the tooth 162 is disposed between the neck 202 and the retention section 164 of the tamper-evident band 106, and engages the retention section 164 to hold the closure 100 in the opened position. The deflectable tab 160 and the retention section 164 may have any suitable configuration that enables the closure 100 and/or the closure system 300 to function as described herein.

Referring again to FIGS. 1 and 2, the container 200 includes a sidewall 203 defining a cavity 204. The container 200 further includes a neck 202 extending from the sidewall 203 and defining an opening 232 to the cavity 204. The neck 202 extends circumferentially about a central axis 119 of the container 200, and includes an interior surface (not labeled) and an exterior surface 212. Further, the neck 202 extends from a first end 206 defining the opening 232 in a top 208 of the container 200, to a second end 210 joined to the sidewall 203. Aspects of the present disclosure are particularly advantageous when used with lightweight containers or bottles. Such containers can have relatively thin sidewalls and necks, and be constructed of, for example and without limitation, lightweight high-density polyethylene (HDPE). In other embodiments, the container 200 can be formed of materials other than lightweight materials and/or have a construction without thin sidewalls.

Figure 9:
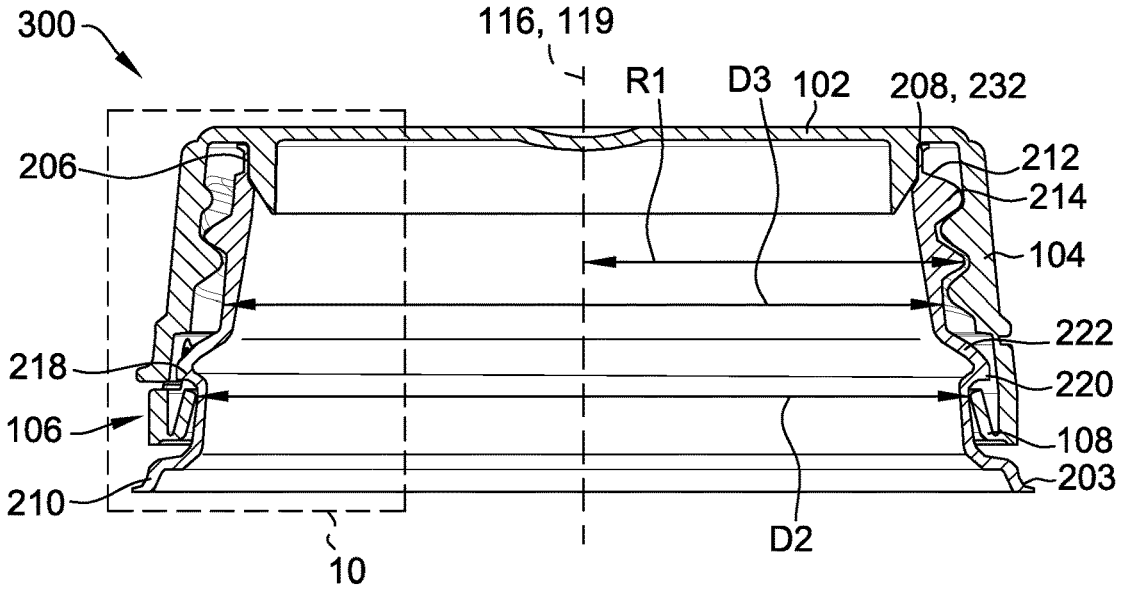
FIG. 9 is another sectional view the closure system of FIG. 1 taken along line 2-2 in FIG. 1.

As shown in FIG. 9, the exterior surface 212 of the neck 202 can include at least one external thread 214 formed on the exterior surface 212. The at least one thread 214 can be a single, continuous external thread extending helically around the neck 202, or the at least one thread 214 can include multiple different threads. The neck 202 also includes a tamper-evident bead 218 that protrudes radially outward form the exterior surface 212 of the neck 202 and circumferentially about the central axis 119. As shown in FIG. 9, the tamper-evident bead 218 includes a generally straight edge 220 facing the second end 210 of the neck 202 and a tapered or curved edge 222 facing the first end 206 of the neck 202. The tamper-evident bead 218 engages the attachment band 108 of closure 100 when the closure 100 is connected to the container 200. Specifically, when the closure 100 is placed on the container neck 202, the attachment band 108 (in the folded configuration) engages the tapered or curved edge 222 of the tamper-evident bead 218, which can cause the attachment band 108 to deflect radially outward as the closure 100 is secured (e.g., screwed on) to the neck 202. Once the attachment band 108 traverses the tamper-evident bead 218, the attachment band 108 returns to an undeflected position and engages the straight edge 220 of the tamper-evident bead 218, which inhibits removal of the attachment band 108 from the container neck 202, even when the rest of the closure 100 is removed.

As shown in FIG. 9, the neck 202 of the container 200 can be radially tapered outward between the first end 206 and the second end 210 of the neck 202 such that an outer diameter D3 of the neck 202 (measured along the exterior surface 212) is smaller near the top, open end 206 of the neck 202 than at the second end 210 of the neck 202. The neck 202 can be tapered along its entire length or along a portion of its length. For example, in the illustrated embodiment, the neck is radially tapered along a threaded region of the neck 202 that includes the at least one thread, and also along an unthreaded region of the neck 202 located between the tamper-evident bead 218 and the second end 210 of the neck 202. In other embodiments, the radial taper of the neck 202 may extend along any portion of the neck 202 that enables closure 100 and/or closure system 300 to function as described herein. In some embodiments, for example, only the threaded region of the neck 202 is tapered radially outward.

Moreover, in the illustrated embodiment, each external thread 214 has a substantially constant height as the thread extends from the first end 206 towards the second end 210. For example, each external thread 214 may have a constant height except for the thread start and end portions.

Figure 10:
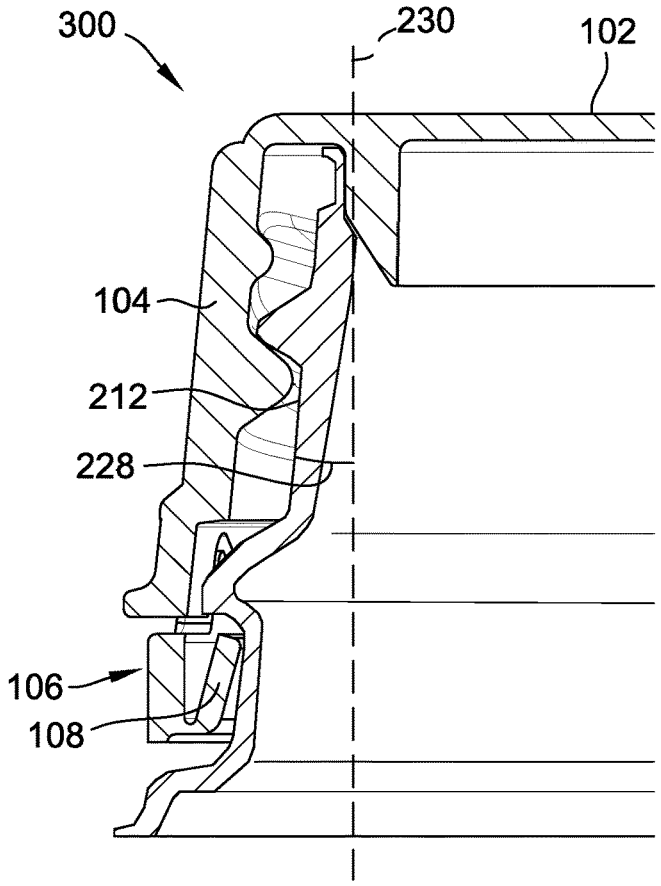
FIG. 10 is an enlarged view of a portion of the closure system shown in FIG. 9.

FIG. 10 is an enlarged view of a portion of FIG. 9. The neck 202 can taper radially outward at any suitable angle that enables the closure 100 and/or the closure system 300 to function as described herein. In some embodiments, an angle 228 of the taper, shown with reference between the exterior surface 212 of the neck 202 and an axis 230 parallel to the central axis 119 can be between about 1° and about 10°, between about 1° and about 8°, between about 2° and about 10°, between about 1° and about 6°, between about 3° and about 8°, between about 5° and about 10°, between about 1° and about 4°, between about 3° and about 6°, between about 5° and about 8°, between about 7° and about 10°, between about 3° and about 5°, between about 4° and about 6°, or between about 5° and about 7°. Moreover, in some embodiments, the neck 202 is tapered at the same angle as the skirt 104 of the closure 100.

Further, as shown in FIG. 9, a radial spacing R1 between the external thread 214 of the neck 202 of the container 200 and the central axis 119 increases as the external thread 214 extends toward the second end 210 of the neck 202. That is, at locations of the external thread 214 that are nearer to the first end 206 of the neck 202, the radial spacing R1 between the external thread 214 and the central axis 119 is smaller than the radial spacing between the external thread 214 and the central axis 119 at locations that are nearer to the second end 210 the neck 202. In the illustrated embodiment, the radial spacing R1 between the at least one external thread 214 of the neck 202 of the container 200 and the central axis 119 increases while the height of each external thread 214 remains the same or substantially the same. That is, the height of each external thread 214 does not decrease (with the exception of the start portion and end portion of each external thread 214) while the radial spacing R1 increases as each external thread 214 extends towards the second end 210.

In one example embodiment, during a filing or capping operation of the container 200, the closure 100 is positioned on top of the opening 232 of the container 200. When the closure 100 is initially positioned on top of the container 200, the attachment band 108 may rest on the tamper-evident bead 218 (specifically, along the top curved edge 222). The closure 100 is subsequently secured to the container 200 by engaging the internal thread 126 of the skirt 104 of the closure 100 with the external thread 214 of the neck 202 of the container 200. During this process, the free end 146 of the attachment band 108 traverses the tamper-evident bead 218 and engages the straight edge 220 of the tamper-evident bead 218 of the neck 202 of the container 200, such that the tamper-evident band 106 is inhibited or prevented from being removed from container 200 with the rest of the closure 100. The attachment band 108 is folded into the folded configuration before the closure 100 is installed onto the container 200. An example of the attachment band 108 in the folded configuration and engaging the tamper-evident bead 218 of the neck 202 of the container 200 is shown in FIG. 9.

The tapered closure 100 and tapered neck 202 of the container 200 facilitate positioning and securing the closure 100 to the container 200 during certain processes, such as filling and/or capping procedures. For example, the increased diameter D2 of the attachment band 108 in the folded configuration and the decreased diameter D3 of the first end 206 of the neck 202 and the corresponding external thread 214 of the neck 202 near the first end 206 of the neck 202 facilitate more securely placing and retaining the closure 100 on the neck 202 of the container 200 prior to the closure 100 being further secured (e.g., threaded) to the container 200. Such a configuration allows for less interference between portions of the closure 100 (e.g., the attachment band 108) and the neck 202 (e.g., external thread 214 of the neck 202 of the container 200), for example, during wipe on closure applications in container filling or capping operations. This configuration consequently allows the closure 100 to sit further down on the neck 202 of the container 200 (i.e., closer to the second end 210 of the neck 202 of the container 200) before the closure 100 is further secured to the container 200 via threading the closure 100 onto the container 200 via the internal thread 126 of the skirt 104 of the closure 100 engaging the external thread 214 of the neck 202 of the container 200. With the closure 100 sitting further down on the neck 202 of the container 200 before the closure 100 is further secured to the container, it is more likely that the closure 100 will remain positioned on the neck 202 of the container 200 before the closure 100 is further secured to the container 200. Additionally, the closure 100 sitting further down on the neck 202 of the container 200 enables the closure 100 to be more-easily secured (e.g., threaded) to the container 200 via production equipment.

Accordingly, when the closure 100 is placed on the container 200 prior to being secured to the container 200, the taper effect integrated into both the closure 100 and the container 200 helps to keep the closure 100 on the container 200 prior to the closure 100 being further secured to the container 200, and also enables the closure 100 to be better secured to the container 200 via production equipment. Such a configuration presents advantages during production (e.g., filling and capping operations) and consumer use.

The tapered configuration of the closure 100 and neck 202 also facilitates opening and closing tethered closures (e.g., by the end user). For example, the increased clearance between the bottom of the closure and the top of the container neck resulting from the tapered configuration allow the tethered closure to be rotated between the closed and open position and vice-versa (e.g., via the hinge) without the closure and neck interfering or impeding movement of the closure.

Moreover, the tapered configuration of the closure 100 and neck 202 allows for a reduced clearance (i.e., tighter fit) between the closure and neck threads when the closure 100 is secured to the neck 202, thereby enhancing the engagement of the closure and neck threads. The increased engagement is particularly advantageous for lightweight containers or bottles (e.g., containers formed of thin-walled plastics, such as lightweight high-density polyethylene (HDPE) used to package fresh milk and juices), where deformation of the container neck might otherwise cause the closure to be dislodged from the container during transport and/or bottle handling.

The present disclosure provides at least the following technical benefits and advantages: (i) eliminating leaks and spills on container filling lines; (ii) eliminating leaks and spills during container distribution; (iii) eliminating leaks and spills during handling and use of the container by consumers; (iv) easy application of the closure to the container on container filling lines, (v) reduction in cost incurred to container filling corporations.

Additionally, the present disclosure provides solutions to at least the following problems: (i) a tendency of conventional closures placed on conventional containers to be inadvertently removed from the container prior to being secured to the container and (ii) application issues related to filling machines with wipe on closure applicators. For example, during wipe on closure applications, closures are presented and applied to the containers via an inclined ramp down which the closures can slide, with the neck of the container being placed at the bottom of the ramp and receiving a closure via the ramp during application. When conventional closures are used in wipe on closure application systems, the conventional closures may be incorrectly placed or aligned on the container on which they are applied in the wipe on application process due to, for example, interference between the internal side surfaces of the closure and the external side surfaces of the neck of the container. Incorrect placement or alignment of closures on the container can result in the closure being incorrectly presented to production equipment later on in the production process, which can cause the closure to be incorrectly (e.g., crookedly) installed on the container. If the closure is incorrectly installed on the container, the closure may not adequately seal the container, and/or the closure may not be adequately secured to the container. For example, if the closure is not adequately secured to the container, pressure within the container (e.g., due to movement or jostling during transport) may cause the closure to be inadvertently removed from the container. Additionally, if the closure is not adequately sealed to the container, then the contents of the container may spill (e.g., during transportation or consumer use).

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A closure for a container, said closure comprising:

a top panel;

a skirt depending from the top panel and extending circumferentially about a central axis, wherein the skirt extends from a first end attached to the top panel to a second end opposite the first end, the skirt having an interior surface and an exterior surface;

a tamper-evident band extending from a first end, attached to the second end of the skirt, to a second end;

an attachment band hingedly connected to the second end of the tamper-evident band; and at least one thread extending from the interior surface of the skirt;

wherein the skirt is tapered radially outward from the first end to the second end such that a diameter of the skirt at the second end is greater than the diameter of the skirt at the first end; and wherein the tamper-evident band is tapered radially outward over at least a portion from the first end to the second end such that an inner diameter of the tamper-evident band at the second end is greater than the inner diameter of the tamper-evident band at the first end.

2. The closure according to claim 1, wherein the at least one thread comprises a plurality of threads.

3. The closure according to claim 2, wherein a radial spacing between the central axis and each thread increases as each thread extends towards the second end of the skirt and a thread height of each thread remains constant.

4. The closure according to claim 1, wherein the tamper-evident band is tethered to the skirt by a hinge such that the skirt remains connected to the tamper-evident band after the closure is opened.

5. The closure according to claim 4, wherein a deflectable tab extends from the hinge, and wherein at least one tooth extends from the deflectable tab and is operable to engage a retention section of the tamper-evident band to hold the closure in an opened position.

6. The closure according to claim 1, wherein a radial spacing between the at least one thread and the central axis increases as the at least one thread extends towards the second end of the skirt.

7. The closure according to claim 1, wherein an angle between the interior surface of the skirt and the central axis is between 1° and 10°.

8. The closure according to claim 1, wherein the tamper-evident band is frangibly attached to the skirt by a plurality of frangible tabs.

9. A closure for a container, said closure comprising:

a top panel including a transition section along an outer peripheral edge thereof;

a skirt depending from the top panel at the transition section and extending circumferentially about a central axis, wherein the skirt extends from a first end attached to the top panel to a second end opposite the first end, the skirt having an interior surface and an exterior surface;

a tamper-evident band extending from a first end, frangibly attached to the skirt by a plurality of frangible tabs at the second end of the skirt, to a second end, wherein the tamper-evident band is tethered to the skirt by a hinge such that the skirt remains connected to the tamper-evident band after the frangible tabs are separated;

an attachment band hingedly connected to the second end of the tamper-evident band;

a deflectable tab extending from the hinge and operable to engage a retention section of the tamper-evident band to hold the closure in an opened position; and a plurality of threads extending from the interior surface of the skirt;

wherein the skirt is tapered radially outward from the first end to the second end such that a diameter of the skirt at the second end is greater than the diameter of the skirt at the first end, and such that a radial spacing between the plurality of threads and the central axis increases as each of the threads extends towards the second end of the skirt; and wherein the tamper-evident band is tapered radially outward over at least a portion from the first end to the second end such that an inner diameter of the tamper-evident band at the second end is greater than the inner diameter of the tamper-evident band at the first end.

10. The closure according to claim 9, wherein the skirt is tapered radially outward at an angle in a range of 1° and 10° relative to the central axis.

11. The closure according to claim 9, wherein the tamper-evident band includes at least one circumferentially extending slot that allows the hinge to move between a closed position and the opened position.

12. The closure according to claim 9, wherein the radial spacing increases as each thread extends towards the second end of the skirt and a thread height of each thread remains constant.

13. A closure system comprising:

a container comprising:

a sidewall defining a cavity; and a neck extending from the sidewall and defining an opening to the cavity, wherein the neck extends from a first end defining the opening to a second end joined to the sidewall, wherein the neck includes at least one thread on an exterior surface thereof, wherein the neck is tapered radially outward from the first end towards the second end; and a closure threadably connectable to the container, the closure comprising:

a top panel;

a skirt depending from the top panel extending circumferentially about a central skirt axis, wherein the skirt extends from a first end attached to the top panel to a second end opposite the first end, the skirt having an interior surface and an exterior surface;

a tamper-evident band extending from a first end, attached to the second end of the skirt, to a second end;

an attachment band hingedly connected to the second end of the tamper-evident band; and at least one thread extending from the interior surface of the skirt and configured to threadably engage the at least one thread of the container neck;

wherein the skirt is tapered radially outward from the first end to the second end such that a diameter of the skirt at the second end is greater than the diameter of the skirt at the first end, wherein a taper angle of the skirt corresponds to a taper angle of the neck; and wherein the tamper-evident band is tapered radially outward over at least a portion from the first end to the second end such that an inner diameter of the tamper-evident band at the second end is greater than the inner diameter of the tamper-evident band at the first end.

14. The closure system according to claim 13, wherein the at least one thread of the neck comprises a plurality of threads and wherein the at least one thread of the closure comprises a plurality of threads.

15. The closure system according to claim 13, wherein the tamper-evident band is tethered to the skirt by a hinge such that the skirt remains connected to the tamper-evident band after the closure is opened.

16. The closure system according to claim 15, wherein a deflectable tab extends from the hinge, and wherein at least one tooth extends from the deflectable tab and is operable to engage a retention section of the tamper-evident band to hold the closure in an opened position.

17. The closure system according to claim 13, wherein a radial spacing between the at least one thread of the closure and the central axis increases as the at least one thread extends towards the second end of the skirt.

18. The closure system according to claim 17, wherein the radial spacing increases as the at least one thread extends towards the second end of the skirt and a thread height of the at least one thread remains constant.

19. The closure system according to claim 13, wherein an angle between the interior surface of the skirt and the central skirt axis is between 1° and 10°.

20. The closure system according to claim 13, wherein the tamper-evident band is frangibly attached to the skirt by a plurality of frangible tabs.

* * * * *